US007325604B2

(12) United States Patent
Wittle et al.

(10) Patent No.: US 7,325,604 B2
(45) **Date of Patent: *Feb. 5, 2008**

(54) METHOD FOR ENHANCING OIL PRODUCTION USING ELECTRICITY

(75) Inventors: J. Kenneth Wittle, Chester Springs, PA (US); Christy W. Bell, Berwyn, PA (US)

(73) Assignee: Electro-Petroleum, Inc., Wayne, PA (US)

( * ) Notice: Subject to any disclaimer, the term of this patent is extended or adjusted under 35 U.S.C. 154(b) by 229 days.

This patent is subject to a terminal disclaimer.

(21) Appl. No.: 11/091,240

(22) Filed: Mar. 28, 2005

(65) Prior Publication Data

US 2005/0199387 A1 Sep. 15, 2005

Related U.S. Application Data

(63) Continuation-in-part of application No. 10/279,431, filed on Oct. 24, 2002, now Pat. No. 6,877,556.

(51) Int. Cl.
*E21B 43/24* (2006.01)

(52) U.S. Cl. ..... 166/248; 166/272.1

(58) Field of Classification Search ..... 166/248, 166/272, 302

See application file for complete search history.

(56) References Cited

U.S. PATENT DOCUMENTS

| | | | |
|---|---|---|---|
| 2,799,641 | A | 7/1957 | Bell |
| 3,724,543 | A | 4/1973 | Bell et al. |
| 3,782,465 | A | 1/1974 | Bell et al. |
| 3,915,819 | A | 10/1975 | Bell et al. |
| 3,948,319 | A | 4/1976 | Pritchett |

(Continued)

OTHER PUBLICATIONS

Connors, Thomas F., et al., "Determination of Standard Potentials and Electron-Transfer Rates for Halobiphenyls from Electrocatalytic Data", Analytical Chemistry, Jan. 1985, vol. 57, No. 1, pp. 170-174.

(Continued)

*Primary Examiner*—William P Neuder
(74) *Attorney, Agent, or Firm*—Patrick J. Hagan, Esq.; Dann, Dorfman, Herrell and Skillman, P.C.

(57) ABSTRACT

A method of enhancing oil production from an oil bearing formation includes the steps of providing a first borehole in a first region of the formation and a second borehole in a second region of the formation. A first electrode is positioned in the first borehole in the first region, and a second electrode is positioned in proximity to the second borehole in the second region. A voltage difference is established between the first and second electrodes to create an electric field across the plugging materials. The electric field is applied to destabilize the plugging materials and improve oil flow through the formation.

14 Claims, 6 Drawing Sheets

U.S. PATENT DOCUMENTS

| | | | | |
|---|---|---|---|---|
| 6,877,556 | B2 * | 4/2005 | Wittle et al. | 166/248 |
| 3,980,053 | A | 9/1976 | Horvath | |
| 4,199,025 | A | 4/1980 | Carpenter | |
| 4,206,024 | A | 6/1980 | Carpenter et al. | |
| 4,382,469 | A | 5/1983 | Bell et al. | |
| 4,473,114 | A | 9/1984 | Bell et al. | |
| 4,495,990 | A | 1/1985 | Titus et al. | |
| 5,012,868 | A | 5/1991 | Bridges | |
| 5,074,986 | A | 12/1991 | Probstein et al. | |
| 5,595,644 | A | 1/1997 | Doring et al. | |
| 5,738,778 | A | 4/1998 | Doring | |

OTHER PUBLICATIONS

Liu, Zhijie, et al., "Electrolytic Reduction of Low Molecular Weight Chlorinated Aliphatic Compounds: Structural and Thermodynamic Effects on Process Kinetics", Environmental Science and Technology, Jan. 2000, vol. 34 No. 5, pp. 804-811.

Shirai, Kimihiro, et al., "Electrochemical Oxidation of 2,2,2-trifluoroethanol to trifluoroacetaldehyde 2,2,2-trifluoroethyl hemiacetal", Tetrahedron Letters, 41, 2000, Elsevier Science Ltd., pp. 5873-5876.

Sonoyama, Noriyuki, et al., "Electrochemical Continuous Decomposition of Chloroform and Other Volatile Chlorinated Hydrocarbons in Water Using a Column Type Metal Impregnated Carbon Fiber Electrode", Environmental Science and Technology, Aug. 1999, vol. 33, No. 19, pp. 3438-3442.

* cited by examiner

METHOD FOR ENHANCING OIL PRODUCTION USING ELECTRICITY

RELATED APPLICATIONS

This application is a continuation-in-part application of U.S. application Ser. No. 10/279,431 filed Oct. 24, 2002 now U.S. Pat. No. 6,877,556, the entire contents of which are incorporated herein by reference.

FIELD OF THE INVENTION

The present invention relates generally to oil production, and more particularly to a method for enhancing the production of oil from subterranean oil reservoirs with the aid of electric current.

BACKGROUND

When crude oil is initially recovered from an oil-bearing earth formation, the oil is forced from the formation into a producing well under the influence of gas pressure and other pressures present in the formation. The stored energy in the reservoir dissipates as oil production progresses and eventually becomes insufficient to force the oil to the producing well. It is well known in the petroleum industry that a relatively small fraction of the oil in subterranean oil reservoirs is recovered during this primary stage of production. Some reservoirs, such as those containing highly viscous crude, retain 90 percent or more of the oil originally in place after primary production is completed.

A variety of conditions in the oil-bearing formation can impede the flow of oil through interstitial spaces in the oil-bearing formation, limiting the recovery of oil. In many cases, formations become damaged during the process of drilling wells into the formation. Mud, chemical additives and other components used in drilling fluids can accumulate around the well, forming a cake that blocks the flow of oil into the well bore. Drilling fluids can also migrate and accumulate in fissures in the formation, blocking the flow of oil through the formation. Parrafins and waxes may precipitate at the interface between the well bore and the formation, further impeding the flow of oil into the well bore. Sediments and native materials in the formation can also migrate and block interstitial spaces.

Numerous methods have been used to alleviate the problems associated with plugging in oil bearing formations. Plugging is often addressed by backflushing the well to remove mud from around the well. Backflushing the well can consume significant time and energy, and has limited effectiveness in unplugging areas that are located deep within a formation and away from the well. Acidizing the well and flushing the well with solvents are also used to alleviate plugging, but these methods can create hazardous waste that is expensive and difficult to dispose of. As a result, known methods for unplugging oil bearing formations leave much to be desired.

In many cases, crude oil is extracted with high concentrations of sulfur, polycyclic aromatic compounds (PAHs) and other compounds that reduce the quality and value of the oil. The presence of undesirable compounds in the oil requires subsequent processing of the oil, increasing the time and cost of production. Therefore, there is a great need to develop oil production methods that allow oil to be treated while it is being extracted.

SUMMARY OF THE INVENTION

The foregoing problems are solved to a great degree by the present invention, which uses electrodes to enhance oil production from an oil bearing formation. A first borehole is provided in a first region of the formation, and a first electrode is positioned in the first borehole. A second electrode may be placed above ground in proximity to the formation. Alternatively, the second electrode may be installed in a second borehole. The second borehole may be positioned in a second region of the formation, or in proximity to the formation. A voltage difference is established between the first and second electrodes to create an electric field across the formation.

It has been discovered that the method of the present invention can be used to improve the condition of the oil formation and repair damaged or plugged formations where oil flow is impeded by drilling fluids, natural occlusions or other matter. The method can also be applied to pre-treat oil in the formation as it is extracted from the formation. The electric field may be applied and manipulated to destabilize occlusions and plugging materials, increase oil flow through the formation and improve the quality of the oil prior to and during extraction.

DESCRIPTION OF THE DRAWINGS

The foregoing summary as well as the following description will be better understood when read in conjunction with the figures in which.

DETAILED DESCRIPTION OF THE PREFERRED EMBODIMENT

Figure 1:
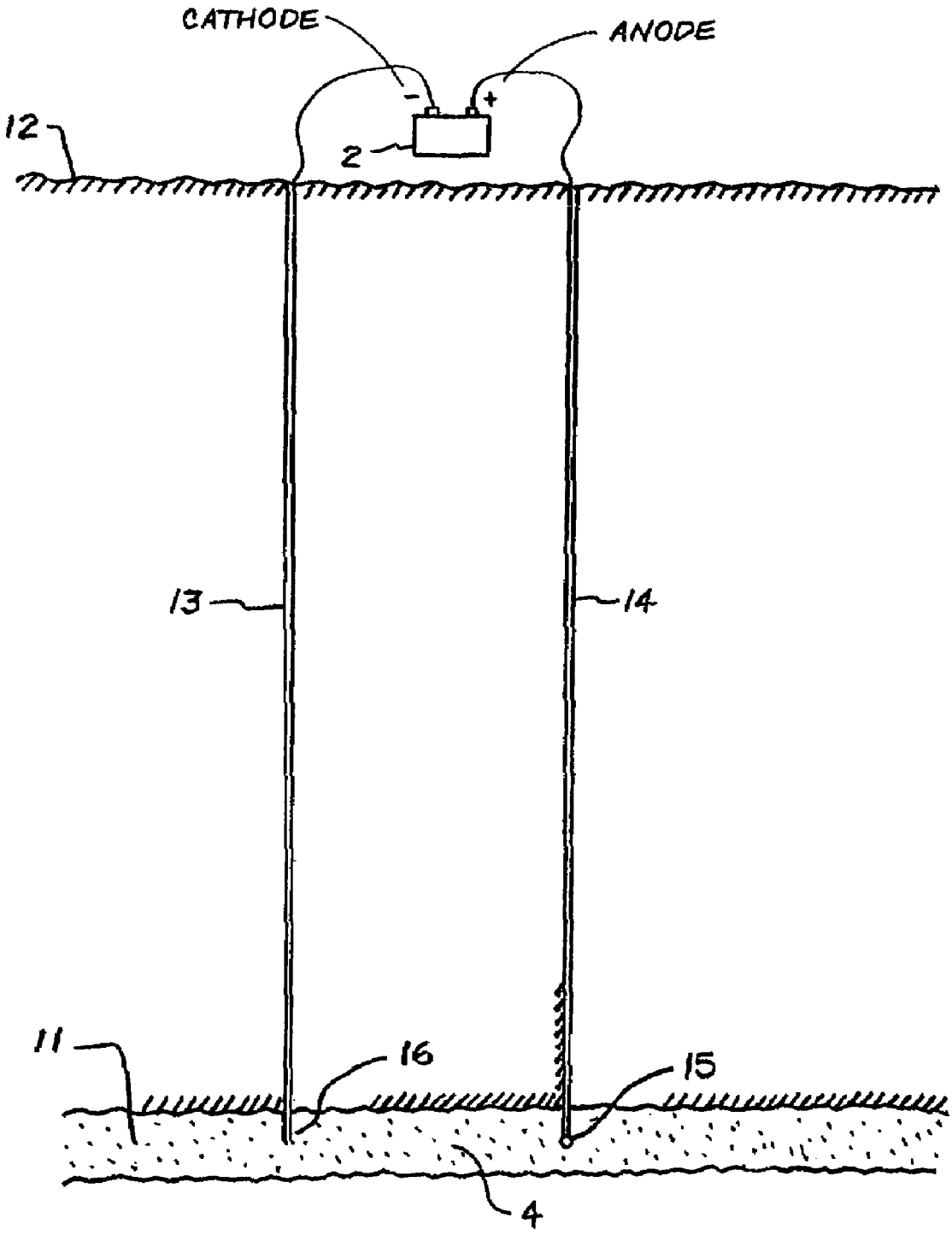
FIG. 1 is a schematic diagram of an improved electrochemical method for stimulating oil recovery from an underground oil-bearing formation.

Referring to the Figures in general, and to FIG. 1, specifically, the reference number 11 represents a subterranean formation containing crude oil. The subterranean formation 11 is an electrically conductive formation, preferably having a moisture content above 5 percent by weight. As shown in FIG. 1, formation 11 is comprised of a porous and substantially homogeneous media, such as sandstone or limestone. Typically, such oil-bearing formations are found beneath the upper strata of earth, referred to generally as overburden, at a depth of the order of 1,000 feet or more below the surface. Communication from the surface 12 to the formation 11 is established through on or more boreholes. In FIG. 1, communication from the surface 12 to the formation 11 is established through spaced-apart boreholes 13 and 14. The hole 13 functions as an oil-producing well, whereas the adjacent hole 14 is a special access hole designed for the transmission of electricity to the formation 11.

The present invention can be practiced using a multiplicity of cathodes and anodes placed in boreholes. The boreholes may be installed in a variety of vertical, horizontal or angular orientations and configurations. In FIG. 1, the system is shown having two electrodes installed vertically into the ground and spaced apart generally horizontally. A first electrode 15 is lowered through access hole 14 to a location in proximity to formation 11. Preferably, first electrode 15 is lowered through access hole 14 to a medial elevation in formation 11, as shown in FIG. 1. By means of an insulated cable in access hole 14, the relatively positive terminal or anode of a high-voltage d-c electric power source 2 is connected to the first electrode 15. The relatively negative terminal on the power source or cathode is connected to a second electrode 16 in producing well 13, or within close proximity of the producing well. Between the electrodes, the electrical resistance of the connate water 4 in the underground formation 11 is sufficiently low so that current can flow through the formation between the first and second electrodes 15, 16. Although the resistivity of the oil is substantially higher than that of the overburden, the current preferentially passes directly through the formation 11 because this path is much shorter than any path through the overburden to "ground."

To create the electric field, a periodic voltage is produced between the electrodes 15, 16. Preferably, the voltage is a DC-biased signal with a ripple component produced under modulated AC power. Alternatively, the periodic voltage may be established using pulsed DC power. The voltage may be produced using any technology known in the electrical art. For example, voltage from an AC power supply may be converted to DC using a diode rectifier. The ripple component may be produced using an RC circuit or through transistor controlled power supplies. Once the voltage is established, the electric current is carried by captive water and capillary water present in the underground formation. Electrons are conducted through the formation by naturally occurring electrolytes in the groundwater.

The electric potential required for carrying out electrochemical reactions varies for different chemical components in the oil. As a result, the desired intensity or magnitude of the ripple component depends on the composition of the oil and the type of reactions that are desired. The magnitude of the ripple component must reach a potential capable of oxidizing and reducing bonds in the oil components. In addition, the ripple component must have a frequency range above 2 hertz and below the frequency at which polarization is no longer induced in the formation. The waveshape of the ripple may be sinusoidal or trapezoidal and either symmetrical or clipped. Frequency of the AC component is preferably between 50 and 2,000 hertz. However, it is understood in the art that pulsing the voltage and tailoring the wave shape may allow the use of frequencies higher than 2,000 hertz.

Figure 2:
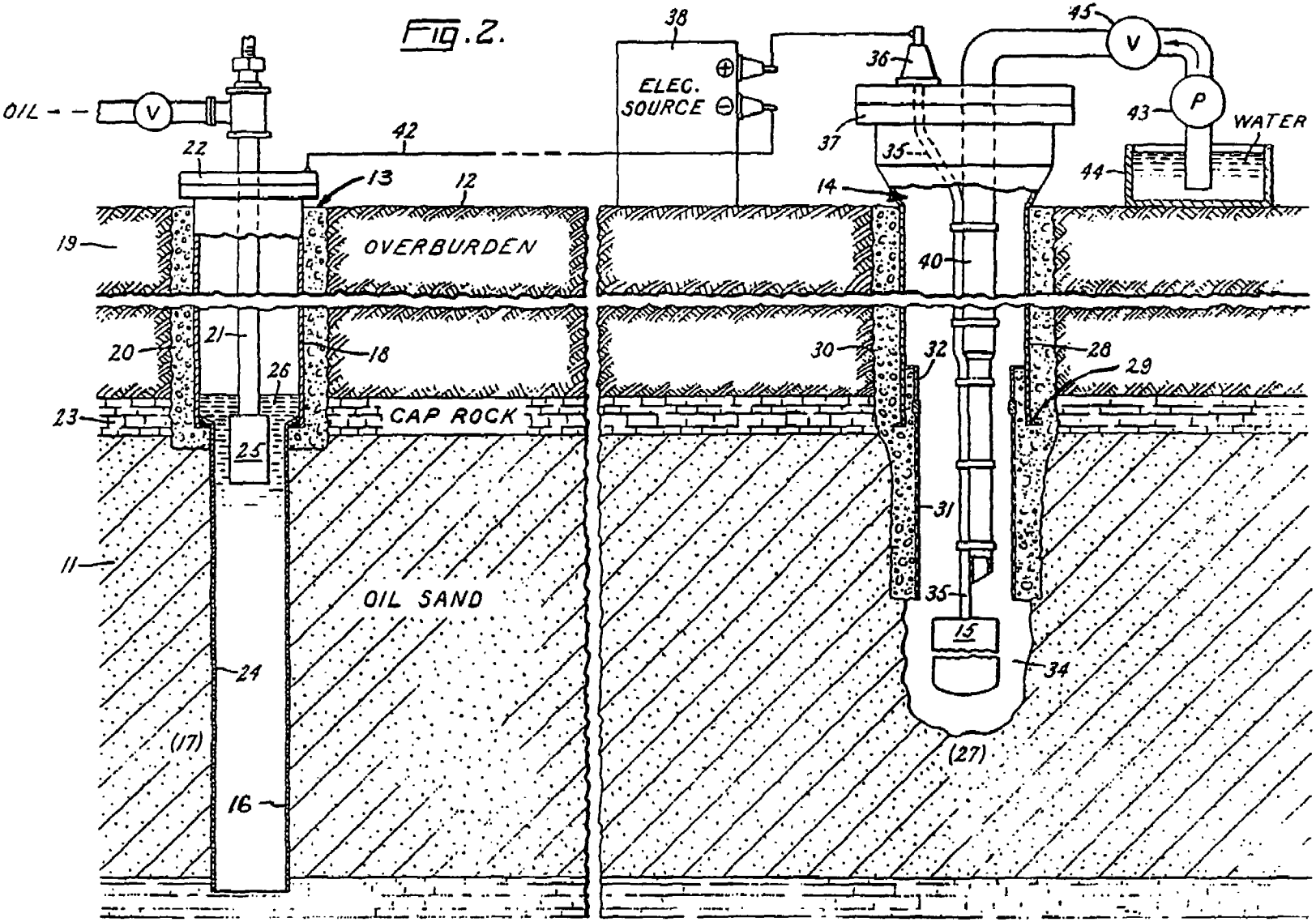
FIG. 2 is a schematic diagram in partial sectional view of an apparatus with which the present method may be practiced.

A system suitable for practicing the invention is shown in FIG. 2. In this system, borehole 13 functions as an oil producing well which penetrates one region 17 of underground oil-bearing formation 11. Well 13 includes an elongated metallic casing 18 extending from the surface 12 to the cap rock 23 immediately above region 17. The casing 18 is sealed in the overburden 19 by concrete 20 as shown, and its lower end is suitably joined to a perforated metallic liner 24 which continues down into the formation 11. Piping 21 is disposed inside the casing 18 where it extends from the casing head 22 to a pump 25 located in the liquid pool 26 that accumulates inside the liner 24. Preferably the producing well 13 is completed in accordance with conventional well construction practice. The pump 25 is selected to operate at sufficient pumping head to draw oil from adjacent formation 11 up through metallic liner 24.

Access hole 14 that contains first electrode 15 includes an elongated metallic casing 28 with a lower end preferably terminated by a shoe 29 disposed at approximately the same elevation as the cap rock 23. The casing 28 is sealed in the overburden 19 by concrete 30. Near the bottom of hole 14, a tubular liner 31 of electrical insulating material extends from the casing 28 for an appreciable distance into formation 11. The insulating liner 31 is telescopically joined to the casing 28 by a suitable crossover means or coupler 32.

Below the liner 31, a cavity 34 formed in the oil-bearing formation 11 contains the first electrode 15. The first electrode 15 is supported by a cable 35 that is insulated from ground. The first electrode 15 is relatively short compared to the vertical depth of the underground formation 11 and may be positioned anywhere in proximity to the formation. Referring to FIG. 2, first electrode 15 is positioned at an approximately medial elevation within the oil-bearing formation 11. The first electrode may be exposed to saline or oleaginous fluids in the surrounding earth formation, as well as a high hydrostatic pressure. Under these conditions, first electrode 15 may be subject to electrolytic corrosion. Therefore, the electrode assembly preferably comprises an elongate configuration mounted within a permeable concentric tubular enclosure radially spaced from the electrode body. The enclosure cooperates with the first electrode body to protect it from oil or other adverse materials that enter the cavity.

It should be noted that FIG. 2 is not to scale, and some of the dimensions of the hole 14 and components in the hole are exaggerated. For example, the diameter of hole 14 is shown to be quite large in comparison to the cable 35 and other components. The diameter of the hole 14 may be much closer to the diameter of the cable 35. In addition, liner 31 preferably has a substantial length and a relatively small inside diameter.

Figure 3:
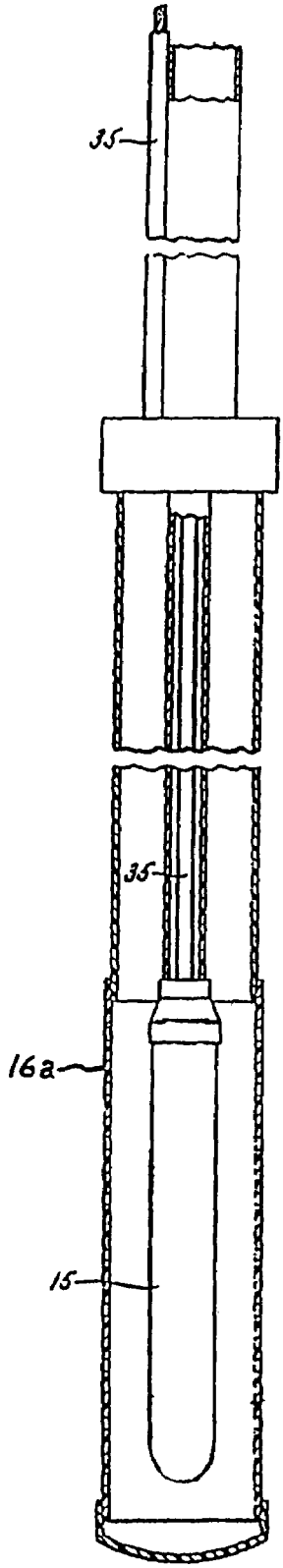
FIG. 3 is an elevational view of an electrode assembly adapted for use in practicing the present invention.

Referring now to FIG. 3, a preferred assembly for the first electrode 15 is shown. The assembly comprises a hollow tubular electrode body 15 electrically connected through its upper end to a conducting cable 35 and disposed concentrically in radially spaced relation within a permeable tubular enclosure **16*a* of insulating material. The first electrode 15 is preferably coated externally with a material, such as lead dioxide, which effectively resists electrolytic oxidation. The assembly preferably includes means to place the internal surfaces of the first electrode 15 under pressure substantially equal to the external pressure to which the first electrode is exposed, thereby to preclude deformation and consequent damage to the first electrode. The enclosure 16*a*** is closed at the bottom to provide a receptacle for sand or other foreign material entering from the surrounding formation.

Referring again to FIG. 2, the first electrode 15 is attached to the lower end of insulated cable 35, the other end of which emerges from a bushing or packing gland 36 in the cap 37 of casing 28 and is connected to the relatively positive terminal of an electric power source 38. The other terminal on the electric power source 38 is connected via a cable 42 to an exposed conductor that acts as a second electrode 16 at the producing well 13. The second electrode 16 may be a separate component installed in the proximity of producing well 13 or may be part of the producing well itself. In the embodiment shown in FIG. 2, the perforated liner 24 serves as the second electrode 16, and the well casing 18 provides a conductive path between the liner and cable 42.

Thus far, it has been presumed that electrodes 15, 16 are located in a formation with a suitable moisture content and naturally occurring electrolytes to provide an electroconductive path through the formation. In formations that do not have adequate capillary and captive groundwater to be electrically conductive, an electroconductive fluid may be injected into the formation through one or both boreholes to maintain an electroconductive path between the electrodes 15, 16. Referring to FIG. 2, a pipe 40 in borehole 14 delivers electrolyte solution from the ground surface to the underground formation 11. Preferably, a pump 43 is used to convey the solution from a supply 44 and through a control valve 45 into borehole 14. Borehole 14 is preferably equipped with conventional flow and level control devices so as to control the volume of electrolyte solution introduced to the borehole. A detailed system and procedure for injecting electrolyte solution into a formation is described in the aforementioned U.S. Pat. No. 3,782,465. See also, U.S. Pat. No. 5,074,986, the entire disclosure of which is incorporated by reference herein.

Referring now to FIGS. 1-2, the steps for practicing the improved method for stimulating oil recovery will now be described. An electric potential is applied to first electrode 15 so as to raise its voltage with respect to the second electrode 16 and region 17 of the formation 11 where the producing well 13 is located. The voltage between the electrodes 15, 16 is preferably no less than 0.4 V per meter of electrode distance. Current flows between the first and second electrodes 15, 16 through the formation 11. Connate water 4 in the interstices of the oil formation provides a path for current flow. Water that collects above the electrodes in the boreholes does not cause a short circuit between the electrodes and surrounding casings. Such short circuiting is prevented because the water columns in the boreholes have relatively small cross sectional areas and, consequently, greater resistances than the oil formation.

As current is applied across formation 11, electrolysis in the capillary water and captive water takes place. Water electrolysis in the groundwater releases agents that promote oxidation and reduction reactions in the oil. That is, negatively charged interfaces of oil compounds undergo cathodic reduction, and positively charged interfaces of the oil compounds undergo anodic oxidation. These redox reactions split long-chain hydrocarbons and multi-cyclic ring compounds into lighter-weight compounds, contributing to lower oil viscosity. Redox reactions may be induced in both aliphatic and aromatic oils. As viscosity of the oil is reduced through redox reactions, the mobility or flow of the oil through the surrounding formation is increased so that the oil may be drawn to the recovery well. Continued application of electric current can ultimately produce carbon dioxide through mineralization of the oil. Dissolution of this carbon dioxide in the oil further reduces viscosity and enhances oil recovery.

In addition to enhancing oil flow characteristics, the present invention promotes electrochemical reactions that upgrade the quality of the oil being recovered. Some of the electrical energy supplied to the oil formation liberates hydrogen and other gases from the formation. Hydrogen gas that contacts warm oil under hydrostatic pressure can partially hydrogenate the oil, improving the grade and value of the recovered oil. Oxidation reactions in the oil can also enhance the quality of the oil through oxygenation.

Electrochemical reactions are sufficient to decrease oil viscosities and promote oil recovery in most applications. In some instances, however, additional techniques may be required to adequately reduce retentive forces and promote oil recovery from underground formations. As a result, the foregoing method for secondary oil recovery may be used in conjunction with other processes, such as electrothermal recovery or electroosmosis. For instance, electroosmotic pressure can be applied to the oil deposit by switching to straight d-c voltage and increasing the voltage gradient between the electrodes 15, 16. Supplementing electrochemical stimulation with electroosmosis may be conveniently executed, as the two processes use much of the same equipment. A method for employing electroosmosis in oil recovery is described in U.S. Pat. No. 3,782,465.

Many aspects of the foregoing invention are described in greater detail in related patents, including U.S. Pat. No. 3,724,543, U.S. Pat. No. 3,782,465, U.S. Pat. No. 3,915,819, U.S. Pat. No. 4,382,469, U.S. Pat. No. 4,473,114, U.S. Pat. No. 4,495,990, U.S. Pat. No. 5,595,644 and U.S. Pat. No. 5,738,778, the entire disclosures of which are incorporated by reference herein. Oil formations in which the methods described herein can be applied include, without limitation, those containing heavy oil, kerogen, asphaltinic oil, napthalenic oil and other types of naturally occurring hydrocarbons. In addition, the methods described herein can be applied to both homogeneous and non-homogeneous formations.

It has been discovered that the method of the present invention can be used to improve the condition of the oil formation and repair damaged or plugged formations where oil flow is impeded. The method can also be applied to pre-treat oil in the formation as it is extracted from the formation.

Figure 4:
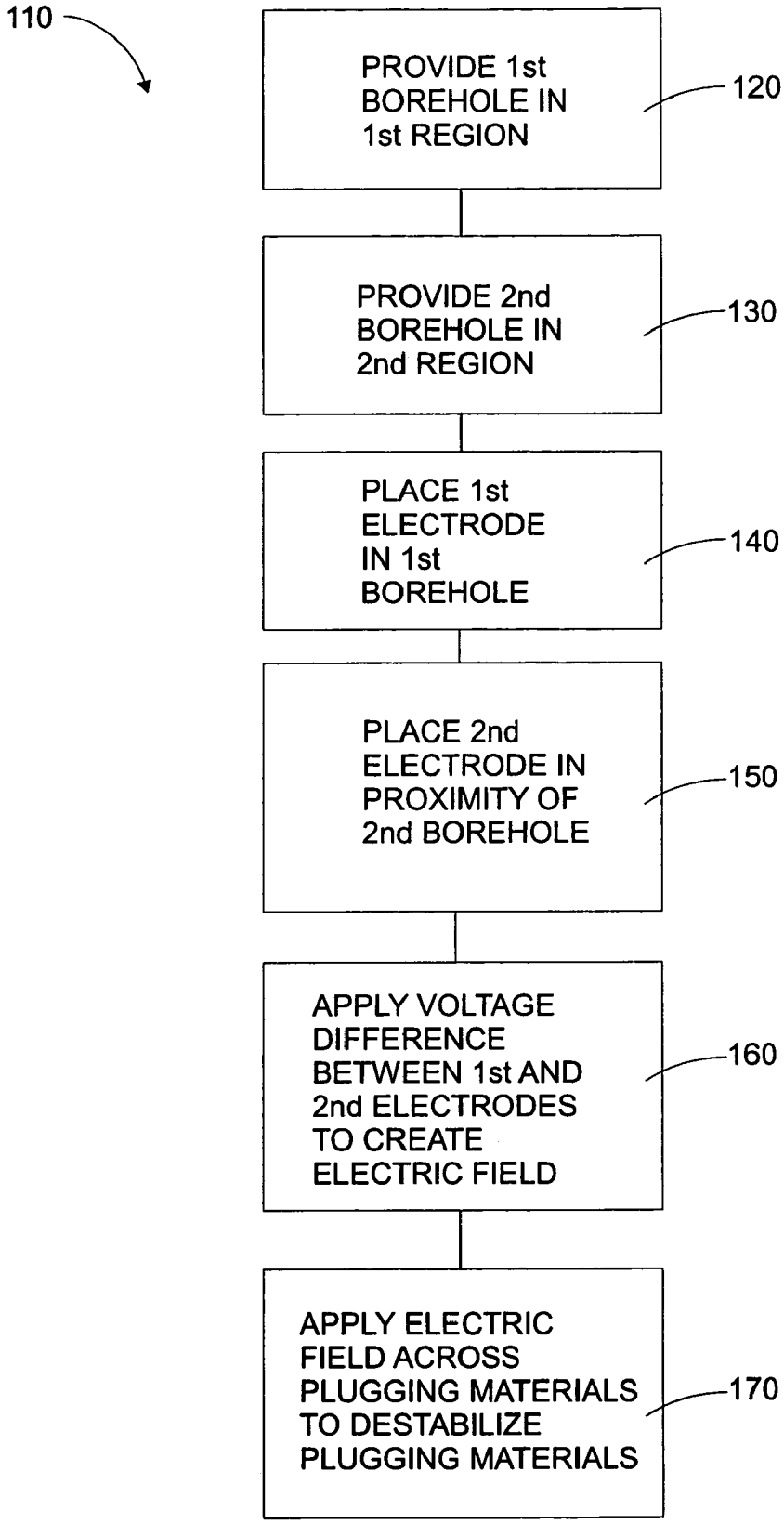
FIG. 4 is a block flow diagram of a method for improving flow conditions and pre-treating oil in a formation.

Referring now to FIG. 4, a method 110 for improving flow conditions and pre-treating oil in a formation is shown in a block diagram. The method 110 is applicable to a variety of well pump installations that draw material from underground formations, including oil recovery wells. The method 110 utilizes electric current to enhance the production of oil from an oil-bearing formation and improve the flow characteristics within the formation. The improved flow characteristics increase the volume of oil that is recoverable from the formation. Electric current is also applied to modify the properties of the oil in the formation and increase the quality of oil recovered. The decomposition of long-chain compounds decreases the viscosity of the oil compounds and increases oil mobility through the formation such that the oil may be withdrawn at the recovery well. Electrochemical reactions in the formation also upgrade the quality and value of the oil that is ultimately recovered.

The components used in the present method include many of the same components described in U.S. patent application Ser. No. 10/279,431. The system generally includes two or more electrodes placed in proximity of the oil bearing formation. In systems using only two boreholes, a first borehole and a second borehole are provided within the underground formation, or in proximity of the underground formation. The first and second boreholes may be drilled vertically, horizontally or at any angle that generally follows the formation. A first electrode is placed within the first borehole and a second electrode is placed within or in proximity of the second borehole. Alternatively, the second electrode may be positioned at the earth's surface. A source of voltage is connected to the first and second electrodes. The first and second boreholes may penetrate the body of oil to be recovered, or they may penetrate the formation at a point beyond but in proximity to the body of oil. A voltage difference is applied between the electrodes to create an electric field through the oil bearing formation.

The method 110 for improving flow conditions and pretreating oil in an underground formation will now be described in greater detail. A first borehole is provided in a first region of the formation in step 120. A second borehole is provided in a second region of the formation in step 130. A first electrode is placed in the first borehole in step 140, and a second electrode is placed in proximity of the second borehole in step 150. A voltage difference is established between the first and second electrodes to create an electric field across plugging materials in the formation in step 160. The electric field is applied across the plugging materials to destabilize the plugging materials in step 170.

The method of FIG. 4 may be applied in several ways to improve flow characteristics in a formation. For example, if a mud cake is deposited on the interface between the well bore and the formation, an electric field may be applied to loosen and remove the mud. A negative electrode is placed in the well bore that is blocked by the mud cake, and the electric field is applied across the mud cake. Formation water will can move through the well bore interface toward the negative electrode under the influence of the electric field. As the water moves through the interface, the electroosmotic forces hydrate the mud and gradually dislodge the clay from the well bore to unblock the well.

The method of FIG. 4 may also be applied to remove plugging materials from fissures within the formation. Plugging materials may include mud or residue from drilling fluid, naturally formed occlusions, or other matter that blocks flow of oil through the interstitial spaces in the formation. The electrode in the well bore may be negatively charged to draw plugging materials into the well bore and out of the formation. Alternatively, the electrode in the well bore may positively charged to repel and push the plugging materials deeper into the formation.

The electric field can be applied alone or in conjunction with other techniques for unplugging formations. For example, the present method may be used in conjunction with acidizing to dissolve and remove clay plugging materials. An unplugging acid is introduced into the formation, and an electrode in the formation is positively charged. An electric field is applied to drive the unplugging acid into the formation until the acid reaches the plugging materials. Migration of the acid is carried out by electroosmosis, but may be assisted by other means, such as well pumping. The electric field may be used to drive the acid into regions of the formation that cannot be reached through boreholes. If desired, the voltage may be increased to impart resistive heating and decrease viscosity of the plugging materials. Additives may be introduced into the formation to change the electric charge of plugging materials. Once the plugging materials are destabilized, the formation may be backflushed to remove any remnants or byproducts remaining in the formation. One or more well pumps may be operated to establish suction pressure in the well and draw the destabilized plugging materials into the well.

As noted above, the present invention promotes electrochemical reactions that upgrade the quality of the oil being recovered. For example, the electric field may be used to remove sulfur-containing compounds from crude, thereby improving the quality and value of oil as it is recovered. It has been found that superimposing a variable AC signal with a frequency between 2 Hz and 1.24 MHz on to a DC signal can induce oxidation to convert sulfur compounds to sulfates. The sulfates tend to remain in the formation as the oil is removed. The present invention may also be applied to remove polycyclic aromatic compounds (PAHS) from crude oil. Operation of the electric field to remove sulfur compounds and PAHs may take place prior to extraction of oil, or while the oil is being extracted. The electric field may be applied for a specified period of time. Alternatively, the electric field may be applied until the concentration of sulfur compounds and/or PAHs is reduced below a predetermined limit.

Figure 5:
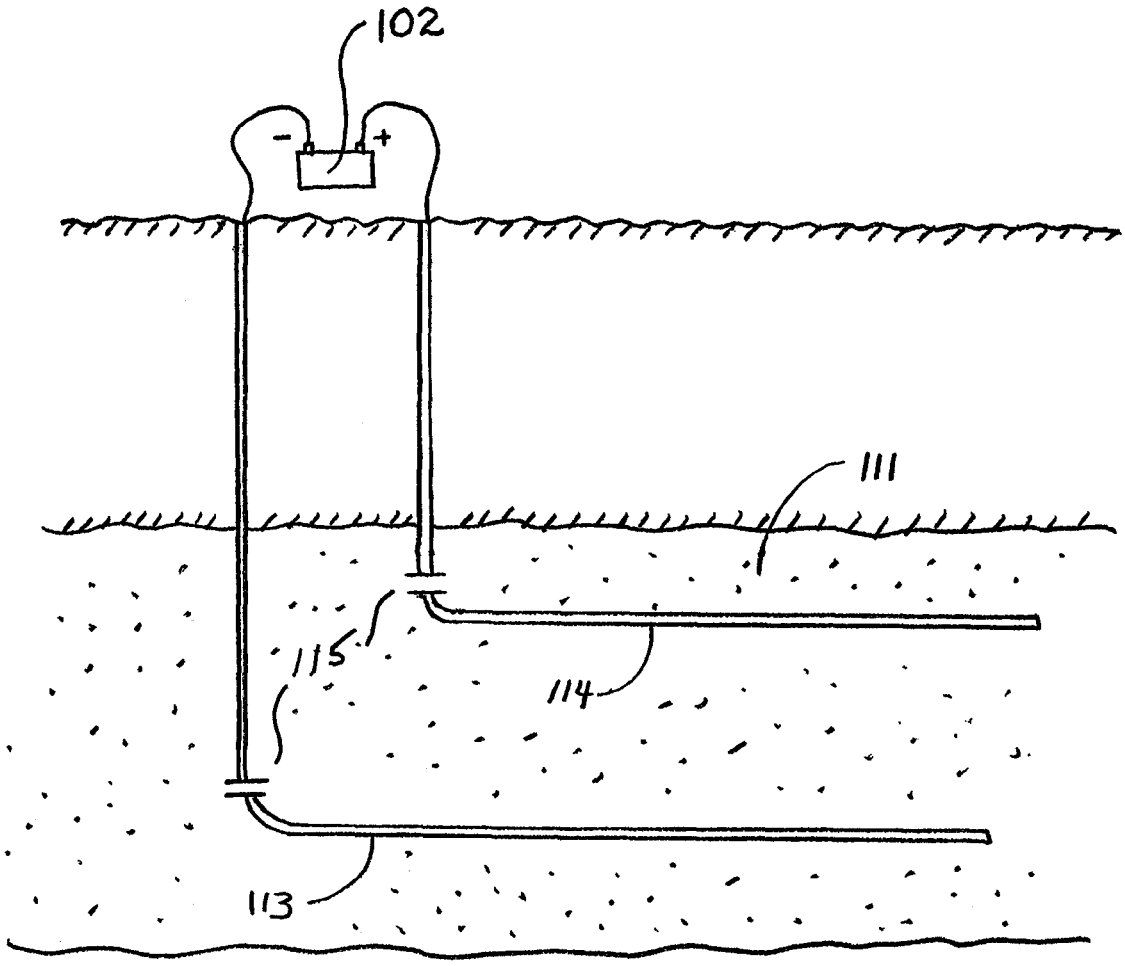
FIG. 5 is a schematic diagram of a first alternate electrochemical method for stimulating oil recovery from an underground oil-bearing formation.

The present invention can be practiced using a multiplicity of cathodes and anodes placed in vertical, horizontal or angular orientations and configurations, as stated earlier. Referring now to FIG. 5, an alternate system is shown with electrodes installed in well casing 113, 114. The well casings 113, 114 extend in a generally horizontal orientation through an oil-bearing formation 111. The relatively positive terminal or anode of a high-voltage d-c electric power source 102 is connected to the first well casing 113. The relatively negative terminal on the power source or cathode is connected to the second well casing 114. In this arrangement, well casing 113 acts as a cathode producer, and well casing 114 acts as an anode. Insulating components or breaks 115 are placed in each of the well casings 113, 114 so that electricity flows between the horizontal sections of the casings within the oil-bearing formation 111. Between the well casings 113, 114, the electrical resistance of the connate water in the formation is sufficiently low so that current can flow through the formation between the casings. Although the resistivity of the oil is substantially higher than that of the overburden, the current preferentially passes directly through the formation 111 because this path is much shorter than any path through the overburden to "ground."

Figure 6:
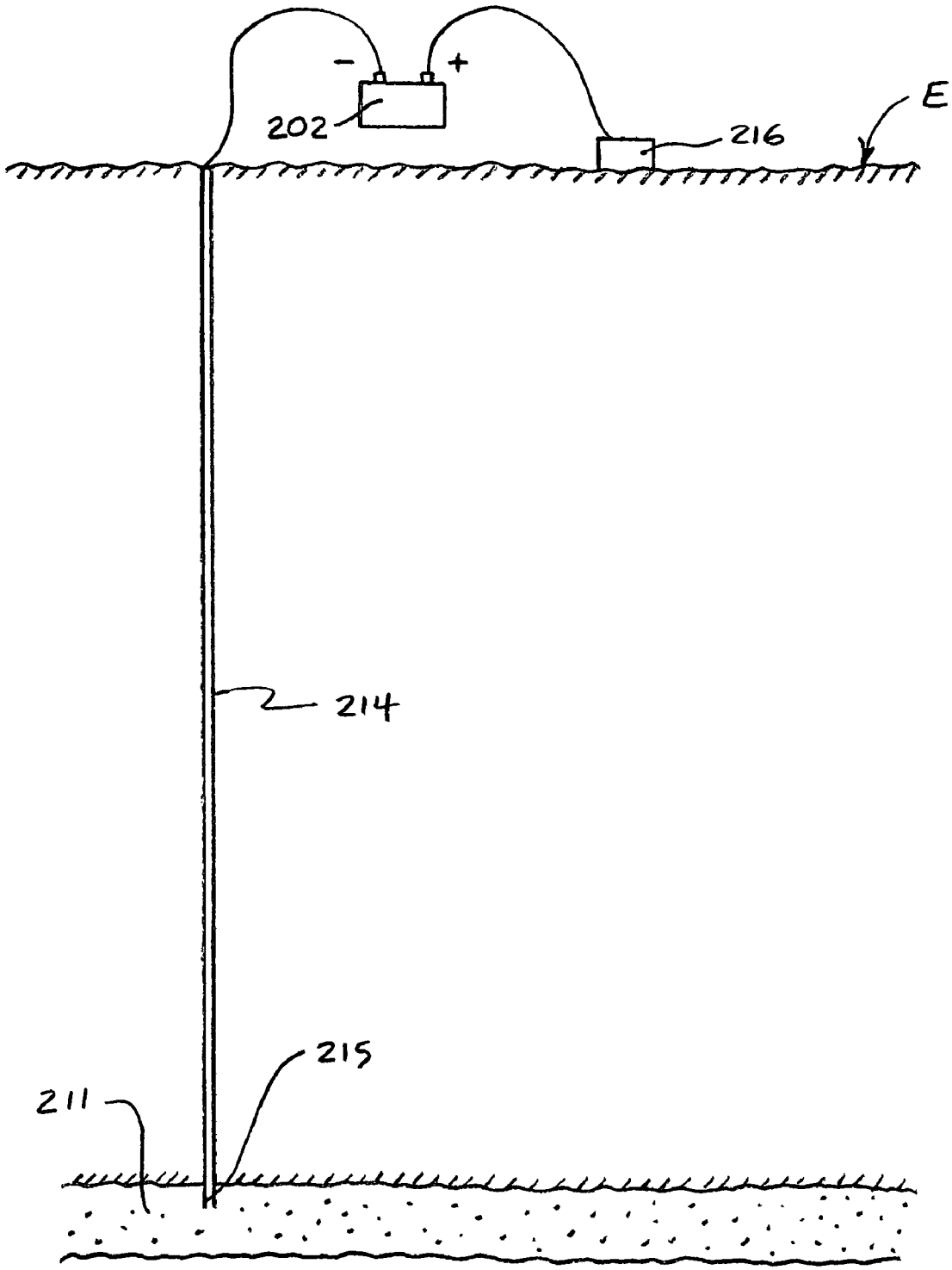
FIG. 6 is a schematic diagram of a second alternate electrochemical method for stimulating oil recovery from an underground oil-bearing formation.

The present method may include one or more electrodes placed above ground, as described earlier. Referring now to FIG. 6, an alternate system is shown with a first electrode 215 placed below the earth's surface (marked "E") and a second electrode 216 placed above the earth's surface in proximity to an underground oil-bearing formation 211. The first electrode 215 is installed in a borehole 214 that penetrates the formation 211. The first electrode 215 is positioned within the formation, but may be positioned outside the formation, depending on the desired position and range of the electric field. The second electrode 216 is placed on the earth's surface. By means of an insulated cable in access hole 214, a terminal on a high-voltage d-c electric power source 202 is connected to the first electrode 215. The opposite terminal on the power source 202 is connected to the second electrode 216. A voltage difference is established between the first and second electrodes 215, 216 to create an electric field across the formation 211. It should be noted that the second electrode 216 may be installed at a shallow depth just beneath the earth's surface to produce an electric field. For example, the second electrode may be installed within fifty feet of the earth's surface to establish an electric field across the formation. Placing the second electrode 216 at a shallow depth below the earth's surface may be desirable where space above ground is limited.

The terms and expressions which have been employed are used as terms of description and not of limitation. Although the present invention has been described in detail with reference only to the presently-preferred embodiments, there is no intention in use of such terms and expressions of excluding any equivalents of the features shown and described or portions thereof. It is recognized that various modifications of the embodiments described herein are possible within the scope and spirit of the invention. Accordingly, the invention incorporates variations that fall within the scope of the following claims.

We claim:

1. A method of enhancing oil production from an oil bearing formation in which plugging materials are present, said plugging materials impeding oil flow in said formation, said formation having a first region and a second region containing formation water, said method comprising the steps of:

A. providing a first borehole in the first region and a second borehole in the second region;

B. positioning a first electrode in the first borehole in the first region;

C. positioning a second electrode in proximity to the second borehole in the second region;

D. introducing additives to modify the electric charge of the plugging materials;

E. establishing a voltage difference between the first and second electrodes to create an electric field across the plugging materials; and F. destabilizing the plugging materials with the electric field to improve oil flow through the formation.

2. The method of claim 1 comprising the steps of applying a DC current through the electrodes to establish a positive electrode and a negative electrode, and drawing the plugging materials toward the positive electrode.

3. The method of claim 1 comprising the steps of applying a DC current through the electrodes to establish a negative electrode in the first borehole, and drawing formation water toward the negative electrode to hydrate plugging materials around the first borehole.

4. The method of claim 3 comprising the step of applying suction pressure in the first borehole to draw hydrated plugging materials into the borehole and out of the formation.

5. The method of claim 1 comprising the steps of applying a DC current through the electrodes to establish a positive charge on the first electrode and a negative charge on the second electrode, and repelling plugging materials away from the first electrode and first borehole.

6. The method of claim 1 comprising the step of introducing an acid into the formation through the first borehole to dissolve the plugging materials.

7. The method of claim 6 comprising the steps of applying a DC current through the electrodes to establish a positive charge on the first electrode and a negative charge on the second electrode, and imparting electroosmotic forces to disperse the acid from the first borehole into the formation to facilitate dissolution of the plugging materials in the formation.

8. The method of claim 1 comprising the step of increasing the voltage difference between the electrodes to heat the plugging materials.

9. The method of claim 1 comprising the step of backflushing the formation after destabilizing the plugging materials.

10. The method of claim 1 comprising the step of processing the oil in situ during application of the electric field through the formation.

11. The method of claim 10 wherein the step of processing the oil comprises the step of maintaining the electric field in the formation until the concentration of sulfur in the oil is decreased below a predetermined limit.

12. The method of claim 10 wherein the step of processing the oil comprises the step of maintaining the electric field in the formation until the concentration of polycyclic aromatic compounds in the oil is decreased below a predetermined limit.

13. The method of claim 1 wherein the step of positioning the first borehole in the first region comprises drilling the borehole in a generally horizontal direction in the formation.

14. The method of claim 1 wherein the steps of positioning the first borehole in the first region and positioning the second borehole in the second region comprises drilling the first and second boreholes in a generally horizontal direction in the formation.

* * * * *